US009528313B1

(12) United States Patent
Arimilli et al.

(10) Patent No.: US 9,528,313 B1
(45) Date of Patent: Dec. 27, 2016

(54) NON-INTRUSIVE, ADAPTIVE TRACKING AND SHADING DEVICE

(71) Applicants: Nathan Dhilan Arimilli, Austin, TX (US); Nevin Kumar Arimilli, Austin, TX (US); Shivani Kumar Arimilli, Austin, TX (US)

(72) Inventors: Nathan Dhilan Arimilli, Austin, TX (US); Nevin Kumar Arimilli, Austin, TX (US); Shivani Kumar Arimilli, Austin, TX (US)

( * ) Notice: Subject to any disclaimer, the term of this patent is extended or adjusted under 35 U.S.C. 154(b) by 0 days.

(21) Appl. No.: 14/871,463

(22) Filed: Sep. 30, 2015

(51) Int. Cl.

| | |
|---|---|
| ***E05F 15/74*** | (2015.01) |
| ***E04F 10/02*** | (2006.01) |
| ***A45B 23/00*** | (2006.01) |
| ***A45B 17/00*** | (2006.01) |
| *E05F 15/73* | (2015.01) |
| *E06B 9/58* | (2006.01) |
| *E06B 9/40* | (2006.01) |

(52) U.S. Cl.
CPC ..... *E05F 15/74* (2015.01); *A45B 17/00* (2013.01); *A45B 23/00* (2013.01); *E04F 10/02* (2013.01); *A45B 2023/0093* (2013.01); *E05F 2015/767* (2015.01); *E06B 2009/405* (2013.01); *E06B 2009/583* (2013.01)

(58) Field of Classification Search
CPC ..... E05F 15/74; E05F 2015/767; E04F 10/02; E06B 2009/1743; E06B 2009/583; E06B 2009/405
USPC ..... 160/242, 243, 253, 255, 258, 241, 277
See application file for complete search history.

(56) References Cited

U.S. PATENT DOCUMENTS

| | | | | |
|---|---|---|---|---|
| 4,574,864 | A * | 3/1986 | Tse | E06B 9/64 160/259 |
| 5,339,848 | A | 8/1994 | Richmond | |
| 6,012,505 | A * | 1/2000 | Wurz | E04B 7/16 135/97 |
| 7,407,178 | B2 | 8/2008 | Freedman | |
| 7,472,739 | B2 * | 1/2009 | Heidenreich | E04F 10/0648 160/122 |
| 7,631,653 | B2 | 12/2009 | Young et al. | |
| 8,051,866 | B2 | 11/2011 | Cutler | |
| 8,118,046 | B2 | 2/2012 | Li | |

(Continued)

FOREIGN PATENT DOCUMENTS

| | | | |
|---|---|---|---|
| DE | 3526745 | A1 * | 2/1987 |
| WO | 2014124213 | A1 | 8/2014 |

*Primary Examiner* — Blair M Johnson
(74) *Attorney, Agent, or Firm* — Brian F. Russell; Russell Ng PLLC

(57) ABSTRACT

A shade device for an outdoor sport court includes: a first guide; a second guide; a first motorized support and a second motorized support both movably attached to the first and second guides; a flexible panel extending between the first motorized support and the second motorized support; a third guide; a fourth guide; a first motorized drive attached to the first and second guides and movably attached to the third guide; a second motorized drive attached to the first and second guides and movably attached to the fourth guide; and a control unit coupled to the first and second motorized supports and the first and second motorized drives. The control unit is configured to control the first and second motorized supports and the first and second motorized drives to provide shade for a moveable object adjacent an area of the court based on a light level at the moveable object.

20 Claims, 15 Drawing Sheets

(56) References Cited

U.S. PATENT DOCUMENTS

| | | | | |
|---|---|---|---|---|
| 8,205,657 | B2 * | 6/2012 | Bohlen | E06B 9/58 160/245 |
| 8,418,741 | B2 * | 4/2013 | Cheung | E06B 9/42 160/241 |
| 8,561,625 | B2 | 10/2013 | Chen | |
| 2004/0261953 | A1 | 12/2004 | Hart | |
| 2012/0193041 | A1 * | 8/2012 | Sun | E06B 9/44 160/241 |
| 2013/0259306 | A1 * | 10/2013 | Lee | E05F 15/203 382/103 |
| 2015/0034261 | A1 * | 2/2015 | Lang | E06B 9/42 160/319 |
| 2015/0285535 | A1 * | 10/2015 | Hall | E06B 9/38 160/1 |

* cited by examiner

NON-INTRUSIVE, ADAPTIVE TRACKING AND SHADING DEVICE

BACKGROUND OF THE INVENTION

The present disclosure relates to a shade device and, more specifically, a non-intrusive, adaptive tracking and shading device, for example, for a sport court.

A number of different types of shade devices are known. For example, U.S. Pat. No. 5,339,848 discloses a motorized sunshade that automatically adjusts its position relative to the sun. In one embodiment the sunshade includes an upright support member (e.g., a pole) and a sunshield (comprising a semicircular member having an arcuate edge and a straight edge). In a disclosed embodiment, the semicircular member comprises a hollow body and two side members slidably received in the hollow body for movement toward and away from each other to adjust the width of the sunshield. The sunshade is pivotally mounted to the support member for movement between a first angular position and a second angular position. A stepper motor (energized based on a timer) and transmission is employed to incrementally move the sunshade between the first and second angular positions to dispose the sunshade in a desired position relative to the position of the sun. The motor may be energized by various power sources, e.g., photovoltaic cells that are mounted on the sunshade or a battery.

As another example, U.S. Pat. No. 7,631,653 discloses an apparatus that may automatically move an umbrella (mounted on a pole) to track the sun. In one embodiment, the apparatus includes a servo motor that is coupled (directly or indirectly) to a pole. The motor may be coupled to a controller that is programmed to cause the umbrella to automatically follow the movement of the sun or to adjust the umbrella at selected time intervals.

As yet another example, U.S. Pat. No. 7,407,178 discloses an automated canopy positioning system that provides protection from the sun as a position of the sun changes. In one embodiment, the system includes an optical sensor (e.g., a photodetector), a controller, and an actuator. The sensor provides a sensor signal based on a sensed orientation. The controller receives the sensor signal from the sensor and provides a control signal based on the sensor signal. The actuator changes an angle of a canopy based on the control signal.

U.S. Pat. No. 8,118,046, as another example, discloses an intelligent outdoor sun shading device that includes a shading system, an environmental sensor device (e.g., a sunlight detector), and a functional controller (e.g., a central processing unit (CPU)). The shading system includes a supporting frame, a power source supported at the supporting frame, an awning frame suspended and movably supported by the supporting frame, and a sun shelter mounted to the awning frame that defines a shaded area under the sun shelter. The environmental sensor device is electrically linked to the power source and is configured to detect an environmental change of the shading system. The functional controller is electrically coupled to the environmental sensor device and operatively controls the awning frame of the shading system. When the functional controller receives a command signal from the environmental sensor device, the awning frame is automatically adjusted (using a motor) to regulate the shading area (e.g., by folding and unfolding the awning frame) in response to the environmental change of the shading system. In one embodiment, the sun shading device includes a wind detector that is configured to detect a wind direction and the sun shelter is adjusted to minimize wind loading on the sun shelter.

U.S. Pat. No. 8,561,625, as yet another example, discloses a sun-tracing sunshade that includes: a support (e.g., a pole); a first top shade member rotatably mounted on the support; a lateral shade member pivotally coupled to the first top shade member; a drive unit installed in the support and adapted to rotate the first top shade member relative to the support; a sun tracker electrically coupled to the drive unit and adapted to sense the direction of the sun and provide a corresponding signal to the drive unit; and a push member mounted on the support and movable to touch the lateral shade member and to further bias the lateral shade member relative to the first top shade member. The first top shade member may comprise a gear. The drive unit may comprise a transmission gear set meshed with the gear of the first top shade member and movable to rotate the first top shade member (to position the lateral shade member to provide optimal shade).

U.S. Pat. No. 8,051,866, as still another example, discloses a covering apparatus for covering an outdoor area (e.g., a pool, a garden, or a tennis court) that includes a screen that can be operated (either manually or automatically by employing motors) between a retracted and an extended configuration. The screen has a leading portion and a trailing portion. The trailing portion is connected to a first support. The covering apparatus further comprises a plurality of longitudinal flexible elements extending from the first support to a respective second support. The leading portion of the screen is supported by the longitudinal flexible elements as the screen is operated from the retracted to the extended configuration. The leading portion of the screen is moveably mounted to the longitudinal flexible elements such that the leading portion moves with respect to the longitudinal flexible elements during operation between retracted and extended positions. At least one clamping system is provided on the leading portion of the screen for releasably clamping the leading portion to at least one of the longitudinal flexible elements.

As yet another example, International Application WO 2014/124213 discloses a retractable (manually or automatically using motors) tennis court shade device. The device is constructed such that it does not impair or provides limited impairment of game play on a tennis court that is being shaded. The device can be constructed substantially along existing fencing structures to surround the entire tennis court, or it can be constructed so that it is parallel to any of the sidelines or baselines or combinations thereof. Alternatively, the device can be constructed such that it is free-standing. The device comprises a frame supported by a plurality of support columns. The frame is disposed at an angle extending inward toward the tennis court while stopping short of completely covering the play area above the tennis court. A plurality of fabric shade panels are retractably attached to the frame. The fabric shade panels filter substantially all of the light and/or UV radiation from the sun. When in place, the fabric shade panels provide shade to a portion of the tennis court which varies over the day. The device can be used in conjunction with fencing that includes a windscreen to provide additional shading.

As a final example, U.S. Patent Application Publication No. 2004/0261953 discloses sail shaped awnings that are attached to a building structure and at least one remote support or column. At least one wire or cable, operable to tension the awning, is connected to a roof or roof support assembly of the building structure to apply a downward restraining force.

BRIEF SUMMARY

The present disclosure appreciates that known shade devices have limitations that may prevent the shade devices from providing optimal shade for a sport participant that is playing a sport on a sport court without also adversely affecting the ability of the sport participant to optimally play the sport.

According to one embodiment of the present disclosure, a shade device for an outdoor sport court includes a first guide and a second guide spaced from the first guide. The first and second guides are substantially parallel. The shade device also includes a first motorized support movably attached adjacent a first end to the first guide and adjacent a second end to the second guide and a second motorized support movably attached adjacent a first end to the first guide and adjacent a second end to the second guide. The shade device further includes a flexible panel extending between the first motorized support and the second motorized support. At least one of the first and second motorized supports includes a motorized spindle that is configured to roll and unroll the flexible panel to correspondingly decrease and increase a size of the flexible panel available to provide shade. The first and second guides are configured to be installed substantially over one dimension of a sport court.

The shade device also includes a third guide and a fourth guide spaced from the third guide. The third and fourth guides are substantially parallel and the third and fourth guides are configured to be installed substantially perpendicular to the first and second guides over another dimension of the sport court. The shade device further includes a first motorized drive attached to the first and second guides and movably attached to the third guide and a second motorized drive attached to the first and second guides and movably attached to the fourth guide. Finally, the shade device includes a control unit coupled to the first and second motorized supports and the first and second motorized drives. The control unit is configured to control the first and second motorized supports and the first and second motorized drives to provide shade for a moveable object (e.g., a sport participant) adjacent an area of the court based on a light level at the moveable object.

The sport court may be, for example, a tennis court. In one embodiment, the shade device further includes a camera coupled to the control unit. In this embodiment, the control unit is configured to control a deployed size and location of the flexible panel based on output from the camera. In at least one embodiment, the control unit is configured to maximize shading of the object while minimizing shading of areas of the court that are not occupied by the object. In another embodiment, the shade device further includes: a receiver coupled to the control unit; a light detector associated with the object and configured to provide an indication of the light level at the object; and a transmitter coupled to the light detector. The transmitter is configured to transmit a signal to the receiver that provides the indication of the light level at the object as detected by the light detector. In this embodiment, the control unit is configured to control the first and second motorized supports and the first and second motorized drives based on the transmitted signal received by the receiver. In at least one embodiment the shade device includes a camera coupled to the control unit. In this embodiment, the control unit is configured to control the first and second motorized supports and the first and second motorized drives based on images captured by the camera. The first, second, third, and fourth guides may be cables and the flexible panel may be a fabric panel.

According to another embodiment, a shade device for an outdoor sport court includes a first member (e.g., an extendable pole) and a second member (e.g., an extendable pipe arm) coupled to the first member adjacent a first end of the second member. The shade device also includes a frame coupled to a second end of the second member. The frame includes a first guide and a second guide spaced from the first guide. The first and second guides are substantially parallel. The shade device further includes a first motorized support movably attached adjacent a first end to the first guide and adjacent a second end to the second guide and a second motorized support movably attached adjacent a first end to the first guide and adjacent a second end to the second guide. The shade device also includes a flexible panel extending between the first motorized support and the second motorized support. At least one of the first and second motorized supports includes a motorized spindle that is configured to roll and unroll the flexible panel to correspondingly decrease and increase a size of the flexible panel available to provide shade. Finally, the shade device includes a control unit coupled to the first and second motorized supports. The control unit is configured to control the first and second motorized supports to provide shade for a moveable object (e.g., a sport participant) adjacent an area of the court based on a light level at the moveable object.

The sport court may be, for example, a tennis court. In at least one embodiment, the shade device further includes a camera coupled to the control unit. In this embodiment, the control unit is configured to control a size and location of the flexible panel based on output from the camera to provide shade for the object. In one embodiment, the control unit is configured to maximize shading of the object while minimizing shading of areas on or adjacent the court that are not occupied by the object. In another embodiment, the shade device further includes: a receiver coupled to the control unit; a light detector associated with the object and configured to provide an indication of the light level at the object; and a transmitter coupled to the light detector. The transmitter is configured to transmit a signal to the receiver that provides the indication of the light level at the object as detected by the light detector. In this embodiment, the control unit may be configured to control the first and second motorized supports, a length of the first member, and a length of the second member based on the transmitted signal received by the receiver.

In another embodiment, the shade device includes a camera coupled to the control unit. In this embodiment, the control unit is configured to control the first and second motorized supports, a length of the first member, and a length of the second member based on images captured by the camera. In at least one embodiment, the first and second members are both configured to telescope and rotate. In this embodiment, the control unit may be configured to control the first and second motorized supports and respective rotational positions and respective lengths of the first and second members to reduce the light level at the object.

DETAILED DESCRIPTION

Disclosed herein are innovative articles, i.e., shade devices, as well as associated methods of manufacture and use. In various embodiments described in detail herein, a shade device is deployed to protect a sport participant from harmful radiation generated by the sun. The general construction of the disclosed shade devices may enhance protection from the sun while at the same time reducing the shading of other areas of a sport court so as to reduce any adverse effects on the ability of a sport participant to play a sport.

Figure 1:
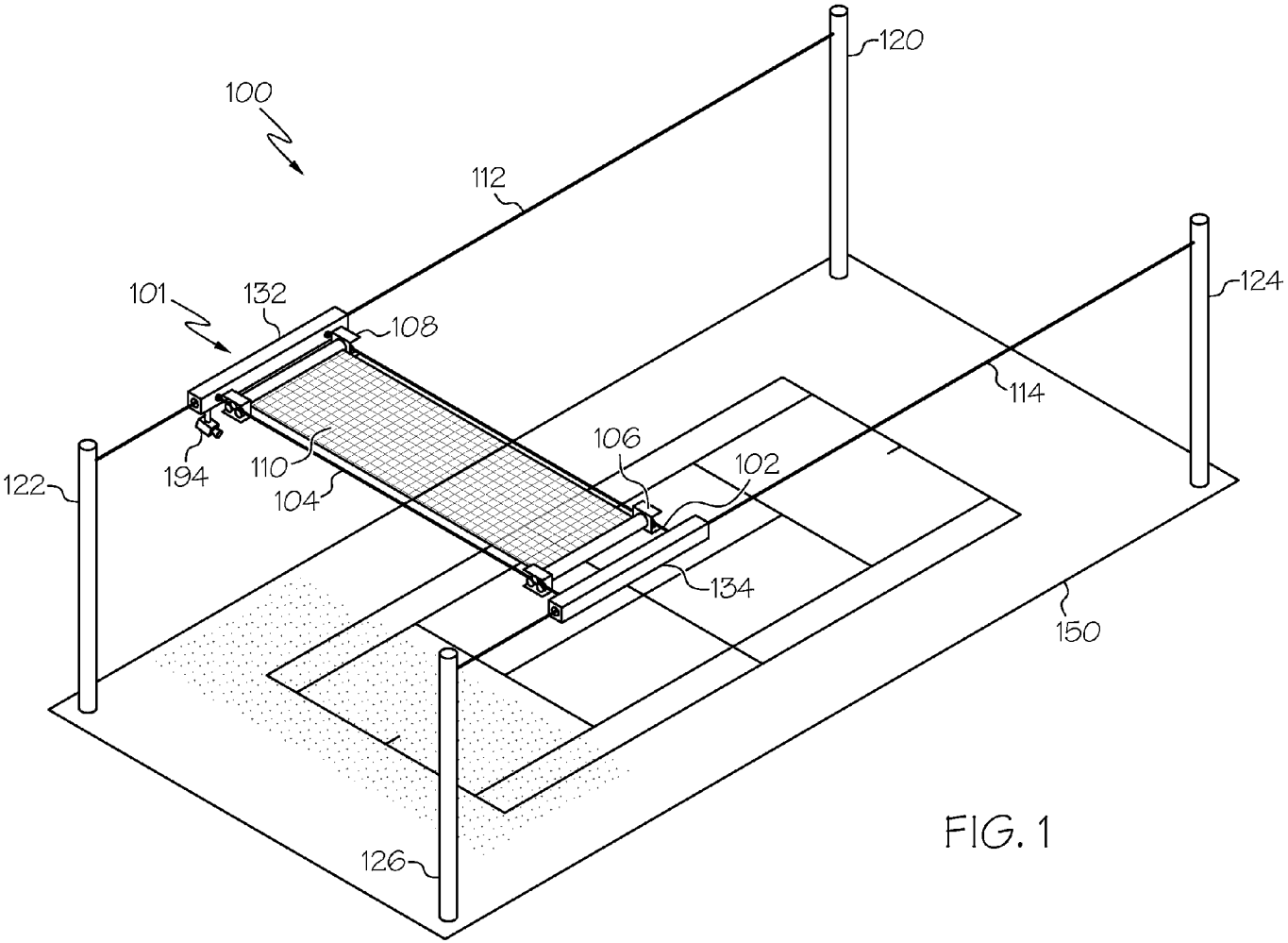
FIG. 1 is a perspective view of a cable-mounted shade device for a sport court in accordance with one embodiment of the present disclosure.

With reference to FIG. 1, a shade device 100 for a sport court 150 is illustrated in accordance with one embodiment of the present disclosure. As is illustrated, shade device 100 includes a single adjustable shade 101. Adjustable shade 101 includes a first guide 102 and a second guide 104 spaced from the first guide 102. As is illustrated, first guide 102 and second guide 104 are substantially parallel. Adjustable shade 101 also includes a first motorized support 106 movably attached adjacent a first end to first guide 102 and adjacent a second end to second guide 104 and a second motorized support 108 movably attached adjacent a first end to first guide 102 and adjacent a second end to second guide 104. Adjustable shade 101 further includes a flexible panel (e.g., a fabric panel that functions as a sunshade) 110 extending between first motorized support 106 and second motorized support 108. At least one of first motorized support 106 and second motorized support 108 includes a motorized spindle (see FIG. 6) that is configured to roll and unroll flexible panel 110 to correspondingly decrease and increase a size of flexible panel 110 available to provide shade. First guide 102 and second guide 104 are configured to be installed over one dimension (in this case a short dimension) of sport court 150, which may be, for example, a tennis court, volleyball court, basketball court, etc.

Shade device 100 also includes a third guide 112 and a fourth guide 114 spaced from third guide 112. As is illustrated, third guide 112 and fourth guide 114 are substantially parallel to each other, substantially perpendicular to first guide 102 and second guide 104, and are configured to be installed over another dimension (in this case a long dimension) of sport court 150. As is shown, third guide 112 is connected at one end to pole 120 and at an opposite end to pole 122. Similarly, fourth guide 114 is connected at one end to pole 124 and at an opposite end to pole 126. For example, third guide 112 may be a cable that includes threaded ends that are secured in holes drilled in posts 120-122 using nuts (not shown). Similarly, fourth guide 114 may be a cable that includes threaded ends that are secured in holes drilled in posts 124-126 using nuts (not shown).

Adjustable shade 101 further includes a first motorized drive 132 (attached to first guide 102 and second guide 104 and movably attached to third guide 112) and a second motorized drive 134 (attached to the first guide 102 and second guide 104 and movably attached to fourth guide 114). For example, first guide 102 may be a cable that includes threaded ends that are secured in holes drilled in a housing of first motorized drive 132 and a housing of second motorized drive 134 using nuts (not shown). Similarly, second guide 104 may be a cable that includes threaded ends that are secured in holes drilled in a housing of first motorized drive 132 and a housing of second motorized drive 134 using nuts (not shown).

Shade device 100 also includes a control unit 192 (not shown in FIG. 1, see FIG. 11) electrically coupled to first motorized support 106, second motorized support 108, first motorized drive 132, and second motorized drive 134 and positioned in a housing. In various embodiments, control unit 192 provides control signals to motors housed within first motorized support 106, second motorized support 108, first motorized drive 132, and second motorized drive 134 based on signals received from camera 194 or receiver 196. Control unit 192 is configured to control first motorized support 106, second motorized support 108, first motorized drive 132, and second motorized drive 134 to provide shade for a moveable object (e.g., a sport participant playing a sport on sport court 150) on and/or adjacent an area of sport court 150 based on a light level at the moveable object. For example, a camera 194 may be deployed to provide an indication of the light level at the sport participant.

Control unit 192 may also be configured to (based on analysis of images provided by camera 194) increase and/or maximize shading of the object while decreasing and/or minimizing shading of areas on or adjacent court 150 that are not occupied by the object. Control unit 192 may, for example, be deployed in a housing that houses camera 194, and images provided by camera 192 may be analyzed by control unit 192 to determine the light level at the sport participant. As another example, a receiver 196 may replace camera 192 and in this case, control unit 192 may be housed in a same housing as receiver 196. In this embodiment, a light detector (e.g., a photodetector) 191 and transmitter 193 may be packaged together and deployed on the sport participant (e.g., clipped to a bill of a hat worn by the sport participant) to transmit an indication of the light level at the sport participant to receiver 196. In various embodiments, electrical power is provided by a DC power source (e.g., a battery).

Figure 2:
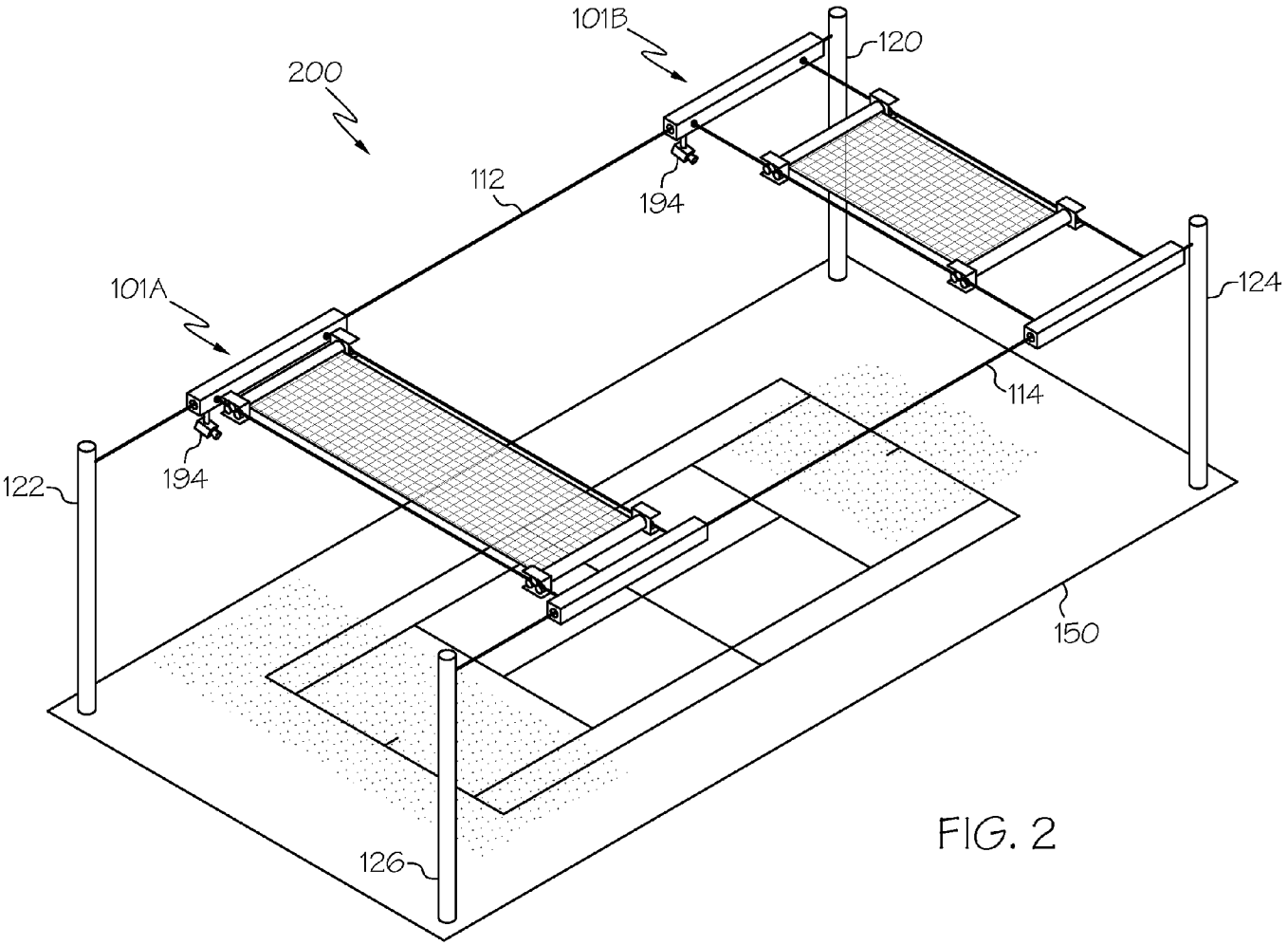
FIG. 2 is a perspective view of a cable-mounted shade device for a sport court in accordance with another embodiment of the present disclosure.

With reference to FIG. 2, a shade device 200 for sport court 150 is illustrated in accordance with another embodiment of the present disclosure. As is illustrated, shade device 200 includes two adjustable shades 101 (i.e., an adjustable shade 101A and an adjustable shade 101B). Shade device 200 is substantially similar to shade device 100, with the exception that shade device 200 includes two adjustable shades 101 while shade device 100 only has one adjustable shade 101. It should be appreciated that a shade device constructed according to the present disclosure may include one or more adjustable shades, which as shown in FIG. 2 may be independently sized, positioned, and moved.

Figure 3:
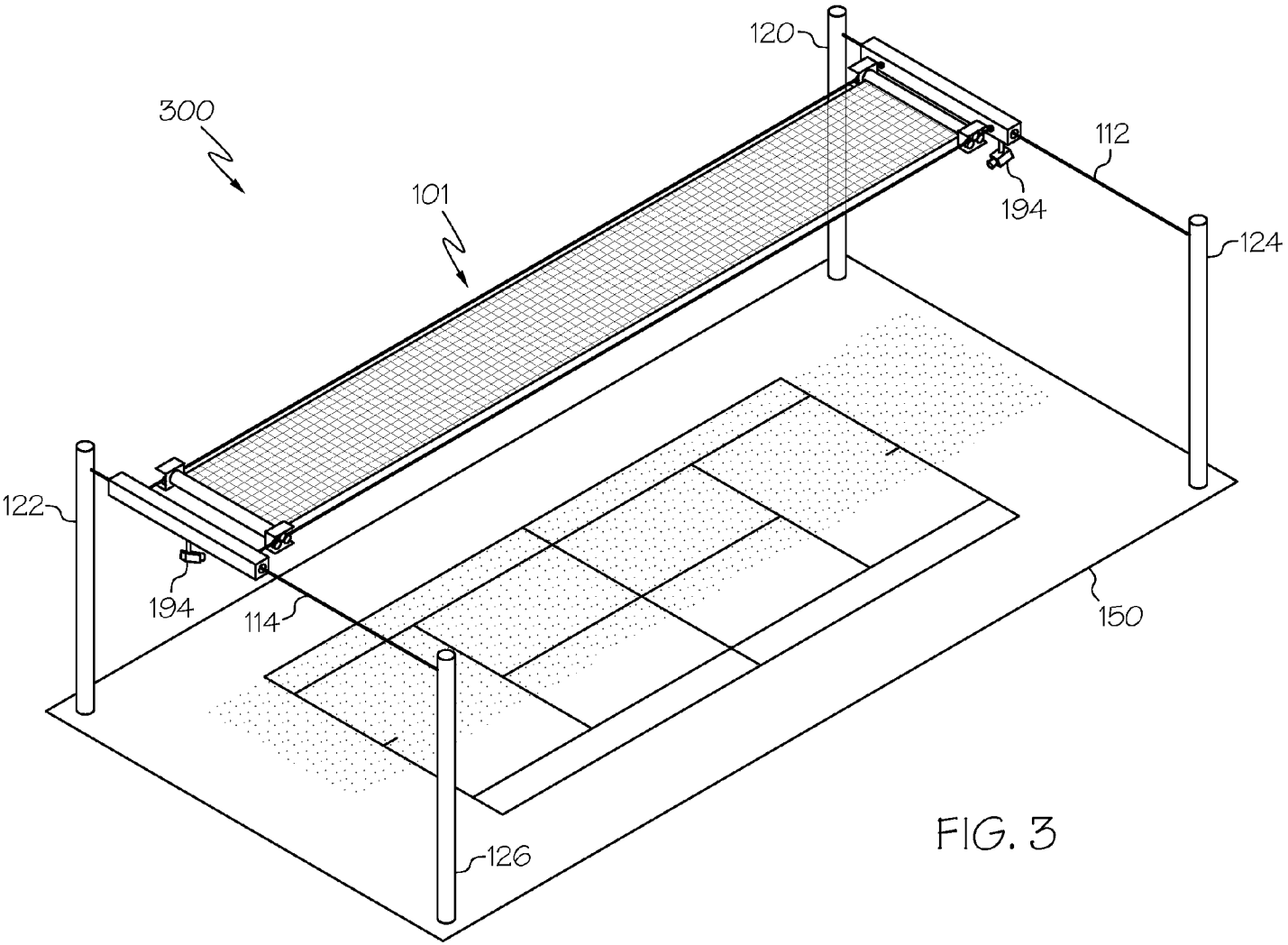
FIG. 3 is a perspective view of a cable-mounted shade device for a sport court in accordance with another embodiment of the present disclosure.

With reference to FIG. 3, a shade device 300 for sport court 150 in accordance with another embodiment of the present disclosure is illustrated. Shade device 300 is similar to shade device 100 with the exception that shade device 300 is oriented one-hundred eighty degrees with respect to shade device 100. Shade device 300 may be preferable to shade device 100 depending on the orientation of sport court 150 with respect to the sun. As is shown, third guide 112 is connected at one end to pole 120 and at an opposite end to pole 124. Similarly, fourth guide 114 is connected at one end to pole 122 and at an opposite end to pole 126. Third guide 112 may be, for example, a cable that includes threaded ends that are secured in holes drilled in posts 120 and 124 using nuts (not shown). Similarly, fourth guide 114 may be a cable that includes threaded ends that are secured in holes drilled in posts 122 and 126 using nuts (not shown).

Figure 4:
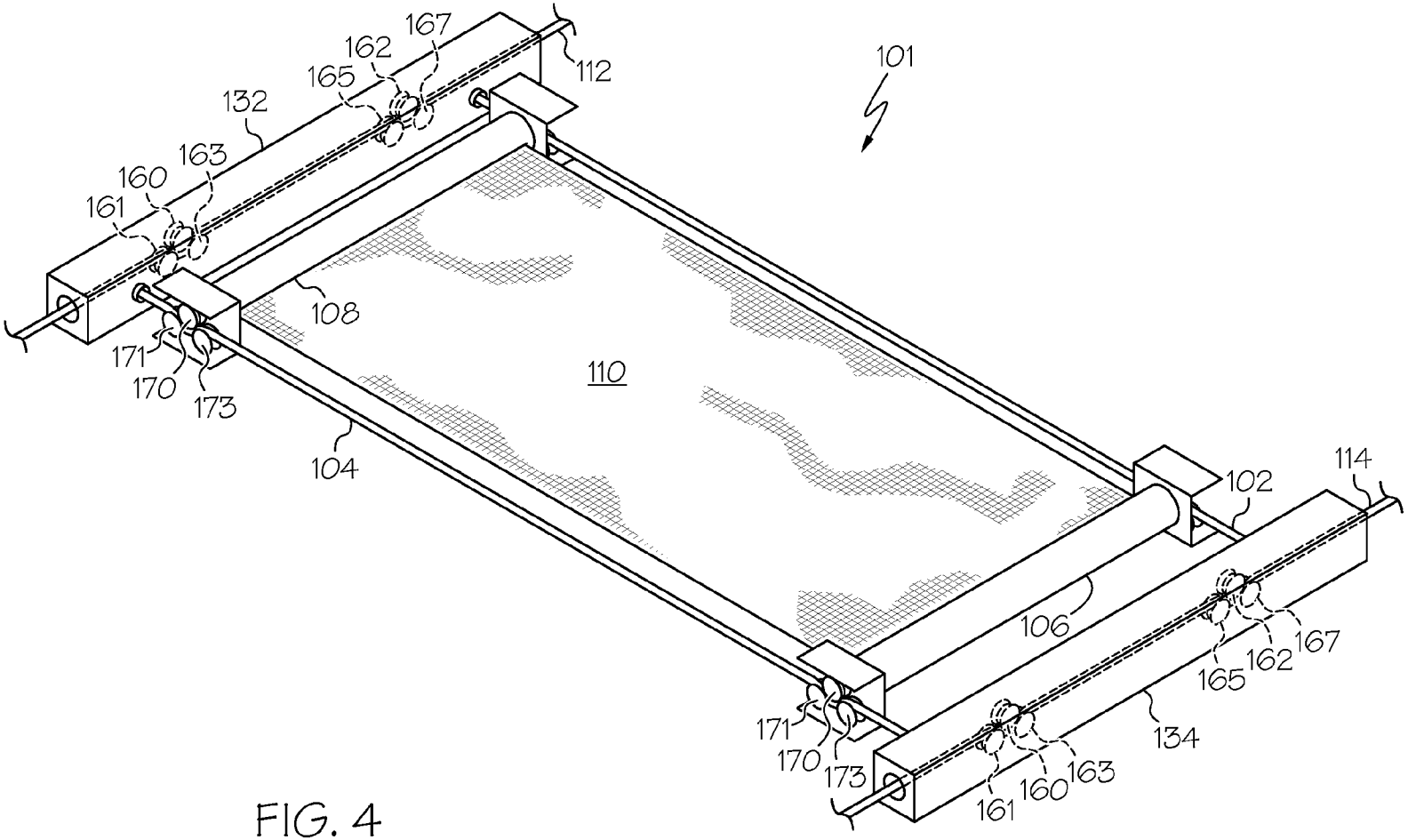
FIG. 4 illustrates relevant portions of drive mechanisms of the shade devices of FIGS. 1-3 in additional detail with a flexible panel (sunshade) deployed in one position in accordance with one embodiment of the present disclosure.

With reference to FIG. 4, relevant portions of exemplary drive mechanisms associated with adjustable shade 101 of FIGS. 1-3 are illustrated with flexible panel 110 deployed in one position in accordance with one embodiment of the present disclosure. As is shown, guide 112 is routed through first and second wheel arrangements that retain first motorized drive 132 on guide 112. The first arrangement includes wheels 160, 161, and 163 and the second arrangement includes wheels 162, 165, and 167. In one embodiment, only wheels 160 and 162 are motor driven. In another embodiment, only one wheel arrangement is implemented in first motorized drive 132. Similarly, guide 114 is routed through first and second wheel arrangements that retain second motorized drive 134 on guide 114. As above, the first arrangement includes wheels 160, 161, and 163 and the second arrangement includes wheels 162, 165, and 167. As above, in one embodiment only wheels 160 and 162 are motor driven. In another embodiment, only one wheel arrangement is implemented in second motorized drive 134.

Figure 5:
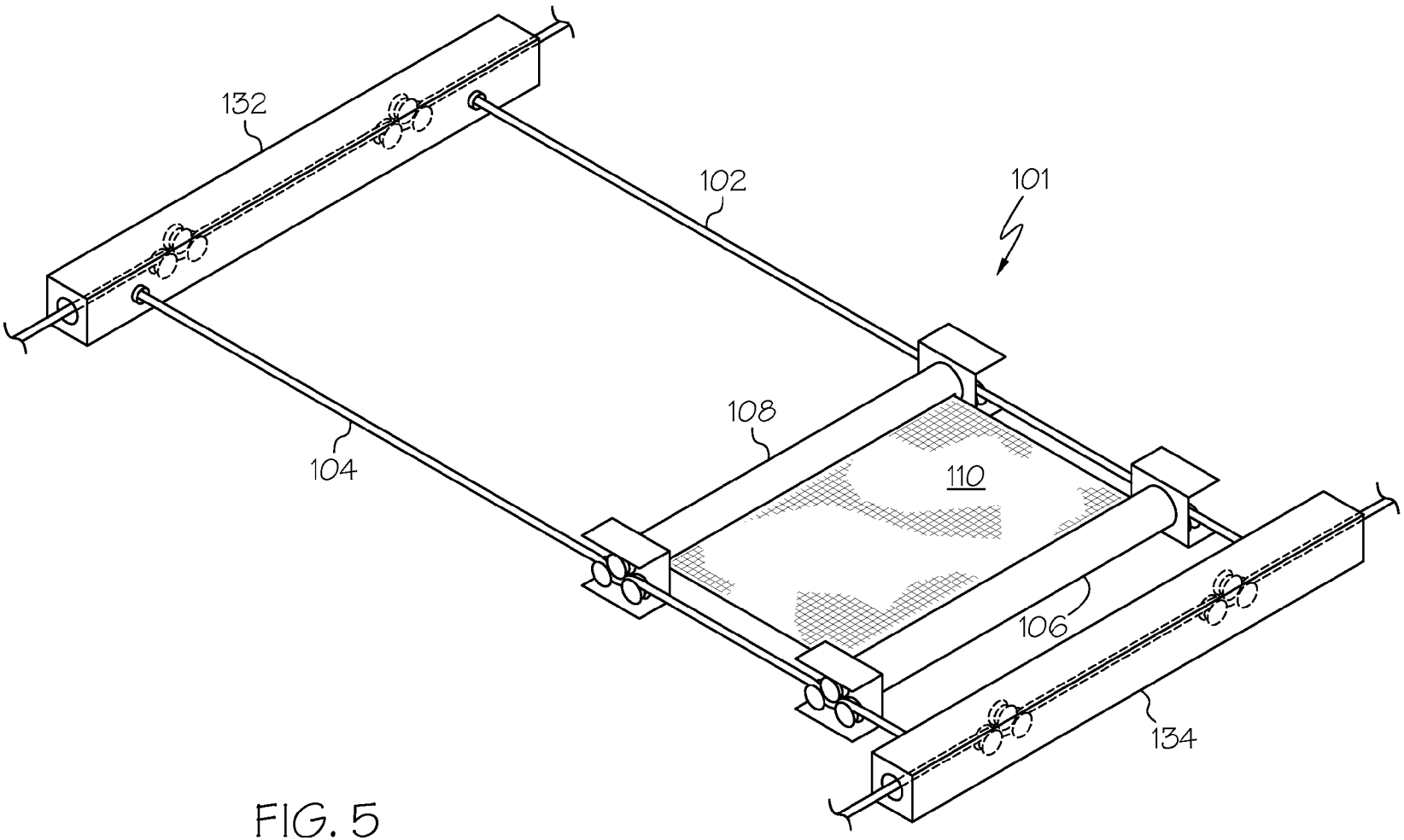
FIG. 5 illustrates relevant portions of drive mechanisms of the shade devices of FIGS. 1-3 in additional detail with the sunshade deployed in another position in accordance with another embodiment of the present disclosure.

As is shown, guide 104 is routed through respective first wheel arrangements of first motorized support 106 and second motorized support 108 that retain first motorized support 106 and second motorized support 108 on guide 104. The first wheel arrangements include wheels 170, 171, and 173. In one embodiment, only wheel 170 is motor driven. Similarly, guide 102 is routed through second wheel arrangements of first motorized support 106 and second motorized support 108 that retain of first motorized support 106 and second motorized support 108 on guide 102. In one embodiment, wheels 170 of first motorized support 106 and second motorized support 108 are both coupled to respective spindles on which flexible panel 110 is rolled and unrolled. In another embodiment only one of first motorized support 106 and second motorized support 108 includes a spindle on which flexible panel 110 is rolled and unrolled. In various embodiments, a spindle located in first motorized support 106 and/or second motorized support 108 may be driven separately from wheels 170. With reference to FIG. 5 relevant portions of drive mechanisms associated with adjustable shade 101 of FIGS. 1-3 are illustrated with flexible panel 110 deployed in another position in accordance with the present disclosure.

Figure 6:
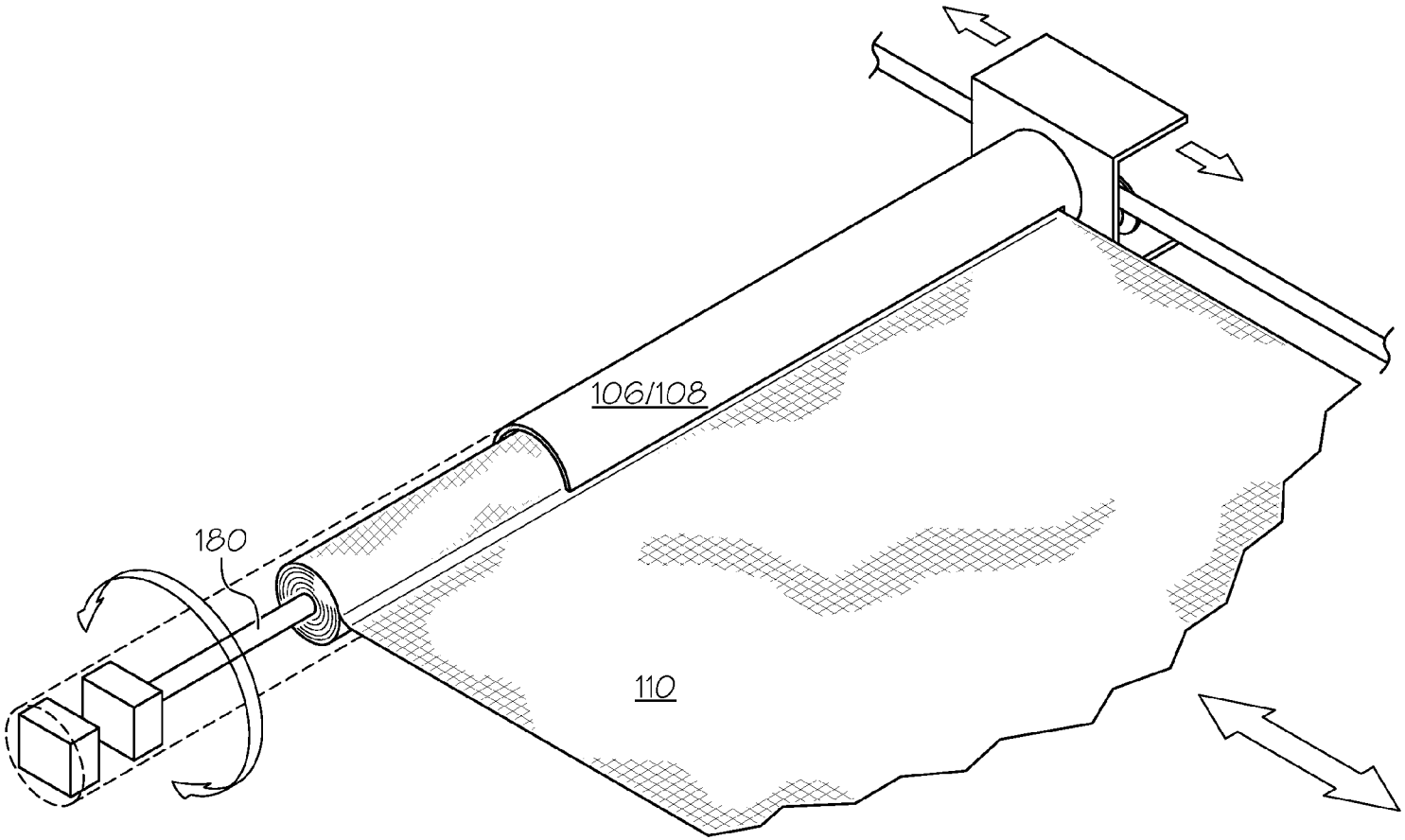
FIG. 6 further illustrates relevant portions of a spindle drive mechanism utilized to roll and unroll the sunshade in accordance with one embodiment of the present disclosure.

With reference to FIG. 6, a cutaway view of first motorized support 106 and second motorized support 108 illustrates flexible panel 110 rolled on a spindle 180 in accordance with one embodiment of the present disclosure. Spindle 180 may be driven separately from wheels 170 or may be driven by a same motor that drives wheels 170 by employing a gear arrangement.

Figure 7:
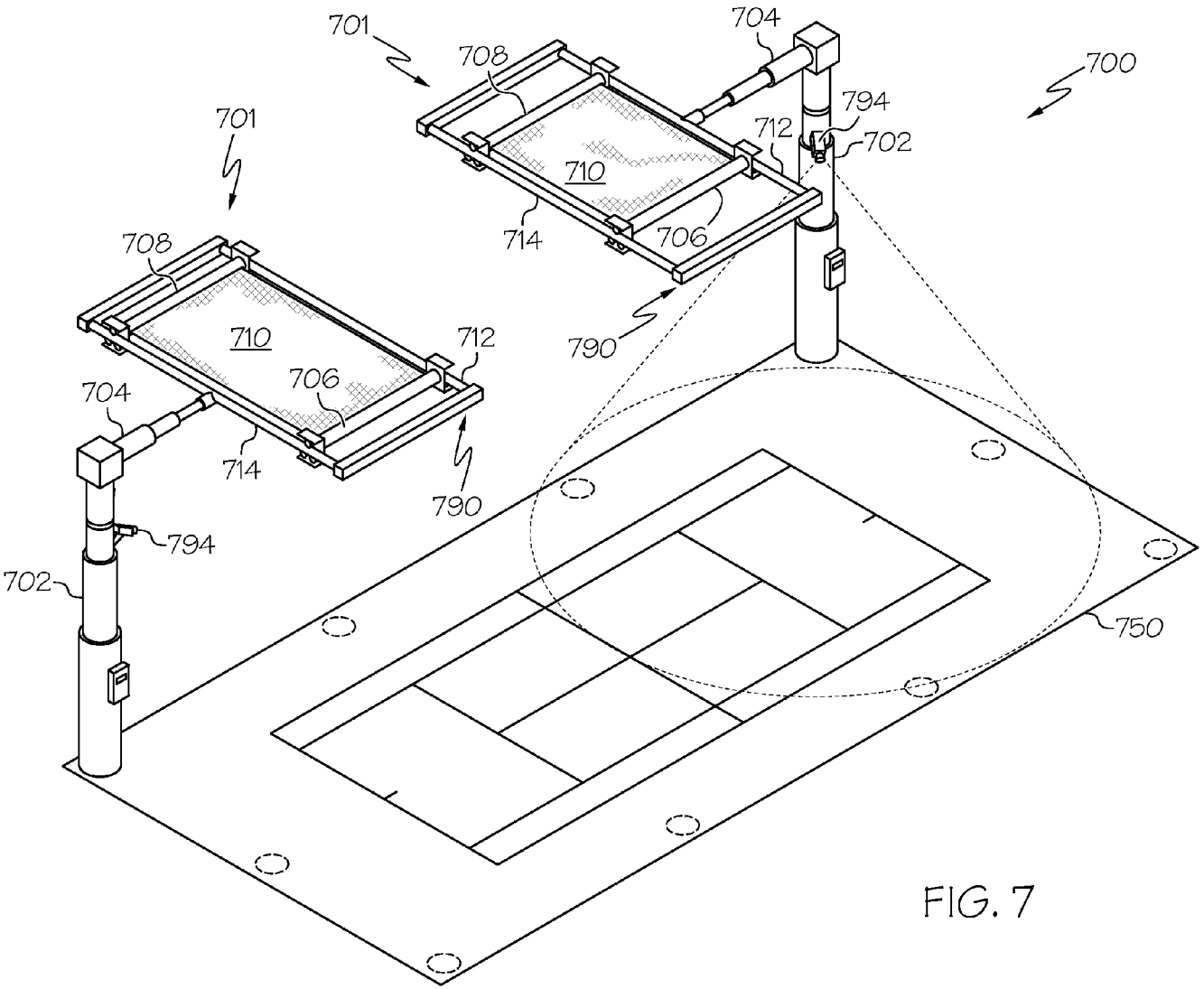
FIG. 7 is a perspective view of pole-mounted shade devices for a sport court configured in accordance with one embodiment of the present disclosure.

With reference to FIG. 7, a pole-mounted shade device 700 having two adjustable shades 701 (in this case one for each of two respective sport participants) for outdoor sport court 750, in accordance with one embodiment of the present disclosure, is illustrated. It should be appreciated that a pole-mounted shade device configured according to the present disclosure may include one or more adjustable shades 701 that may be configured in a same fashion or a different fashion. Each adjustable shade 701 of shade device 700 includes a first member 702, a second member 704 coupled to first member 702 adjacent a first end of second member 704, and a frame 790 coupled to a second end of second member 704. Frame 790 includes a first guide 712 and a second guide 714 spaced from first guide 712. In one or more embodiments, first guide 712 and second guide 714 are substantially parallel and attached at both ends by respective end bars. Adjustable shade 701 also includes a first motorized support 706 movably attached adjacent a first end to first guide 712 and adjacent a second end to second guide 714 and a second motorized support 708 movably attached adjacent a first end to first guide 712 and adjacent a second end to second guide 714.

Adjustable shade 701 further includes a flexible panel 710 extending between first motorized support 706 and second motorized support 708. At least one of first motorized support 706 and second motorized support 708 includes a motorized spindle that is configured to roll and unroll flexible panel 710 to correspondingly decrease and increase a deployed size of flexible panel 710 available to provide shade. In various embodiments, shade device 701 also includes a control unit 792 (not shown in FIG. 7, see FIG. 12) electrically coupled to motors of first motorized support 706 and second motorized support 708. Control unit 792 is configured to control first motorized support 706 and second motorized support 708 to provide shade for a moveable object (i.e., a sport participant) adjacent an area of court 750 based on a light level at the moveable object.

In at least one embodiment, sport court 750 is a tennis court. In one or more embodiments, shade device 700 includes a camera 794 coupled to control unit 792. In this embodiment, control unit 792 is configured to control a size and location of flexible panel 710 based on output from camera 794 to provide shade for the object. Control unit 792 may also be configured to increase and/or maximize shading of the object while reducing and/or minimizing shading of areas on or adjacent court 750 that are not occupied by the object. In another embodiment, shade device 700 also includes a receiver 796 coupled to control unit 792, a light detector 791 associated with the object and configured to provide an indication of the light level at the object, and a transmitter 793 coupled to light detector 791. In this embodiment, transmitter 793 is configured to transmit a signal to receiver 796 that provides the indication of the light level at the object as detected by light detector 791.

In at least one embodiment, control unit 792 is configured to control first motorized support 706 and second motorized support 708, a length of first member 702, and a length of second member 704 based on the transmitted signal received by receiver 796. In another embodiment, shade device 700 further includes camera 794 coupled to control unit 792. In this embodiment, control unit 792 is configured to control first motorized support 706 and second motorized support 708, a length of first member 702, and a length of second member 704 based on images captured by camera 794. In one or more embodiments, first member 702 and second member 704 are both configured to telescope and rotate. In at least one embodiment, control unit 792 is configured to control first motorized support 706 and second motorized support 708 and respective rotational positions and respective lengths of first member 702 and second member 704 to reduce the light level at the object.

As one example, a camera 794 may be deployed to provide an indication of the light level at the sport participant. In this case, control unit 792 may be deployed in a housing that houses camera 794 and images provided by camera 792 may be analyzed by control unit 792 to determine the light level at the sport participant. As another example, receiver 796 may replace camera 794 and in this case, control unit 792 may be housed in a same housing as receiver 796. In this embodiment, a light detector (e.g., a photodetector) 791 and transmitter 793 may be packaged together and deployed on the sport participant (e.g., clipped to a bill of a hat worn by the sport participant) to transmit an indication of the light level at the sport participant to receiver 796.

Figure 8:
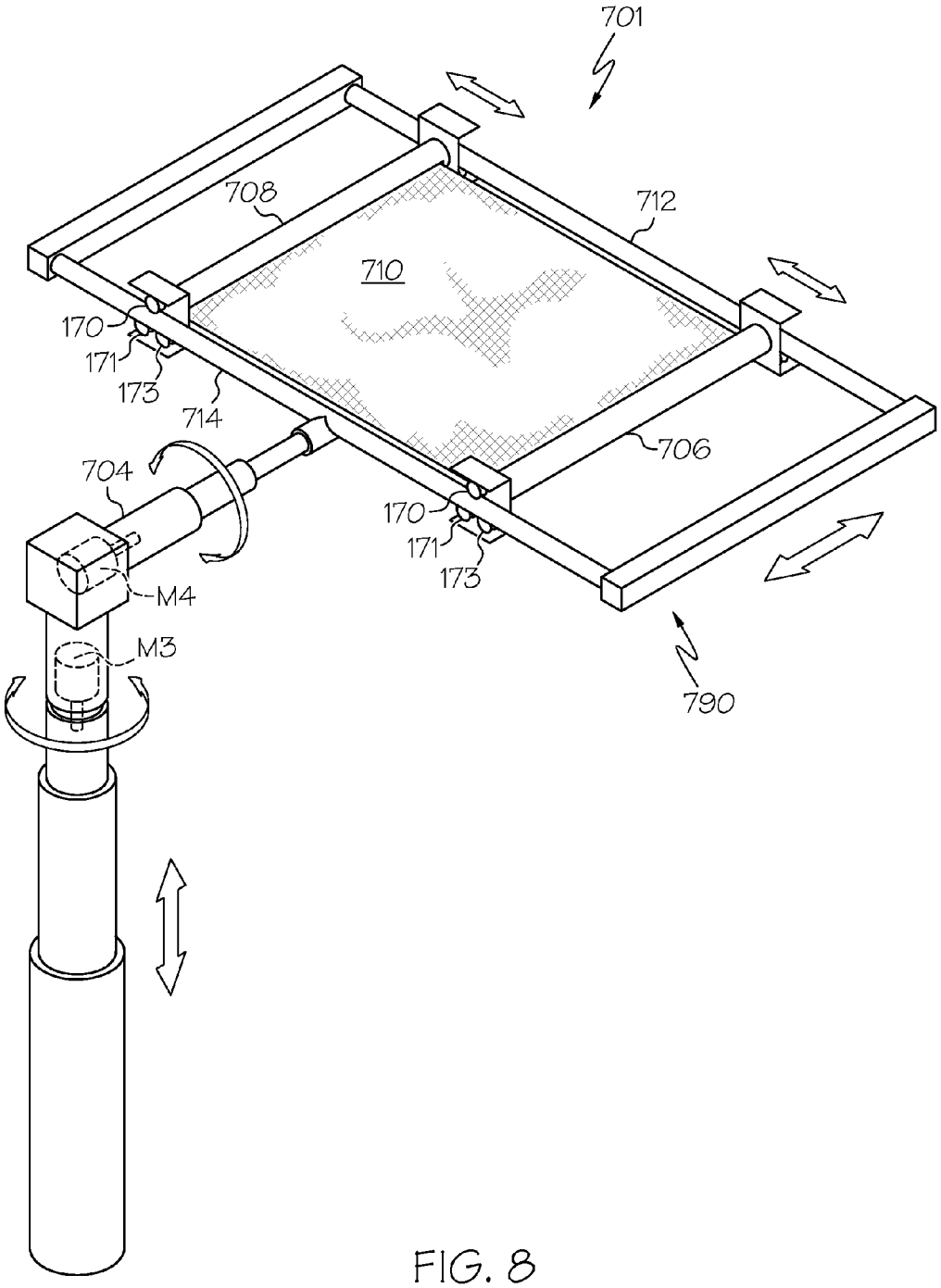
FIG. 8 further illustrates one of the pole-mounted shade devices of FIG. 7 in additional detail deployed in a first position in accordance with one embodiment of the present disclosure.
Figure 9:
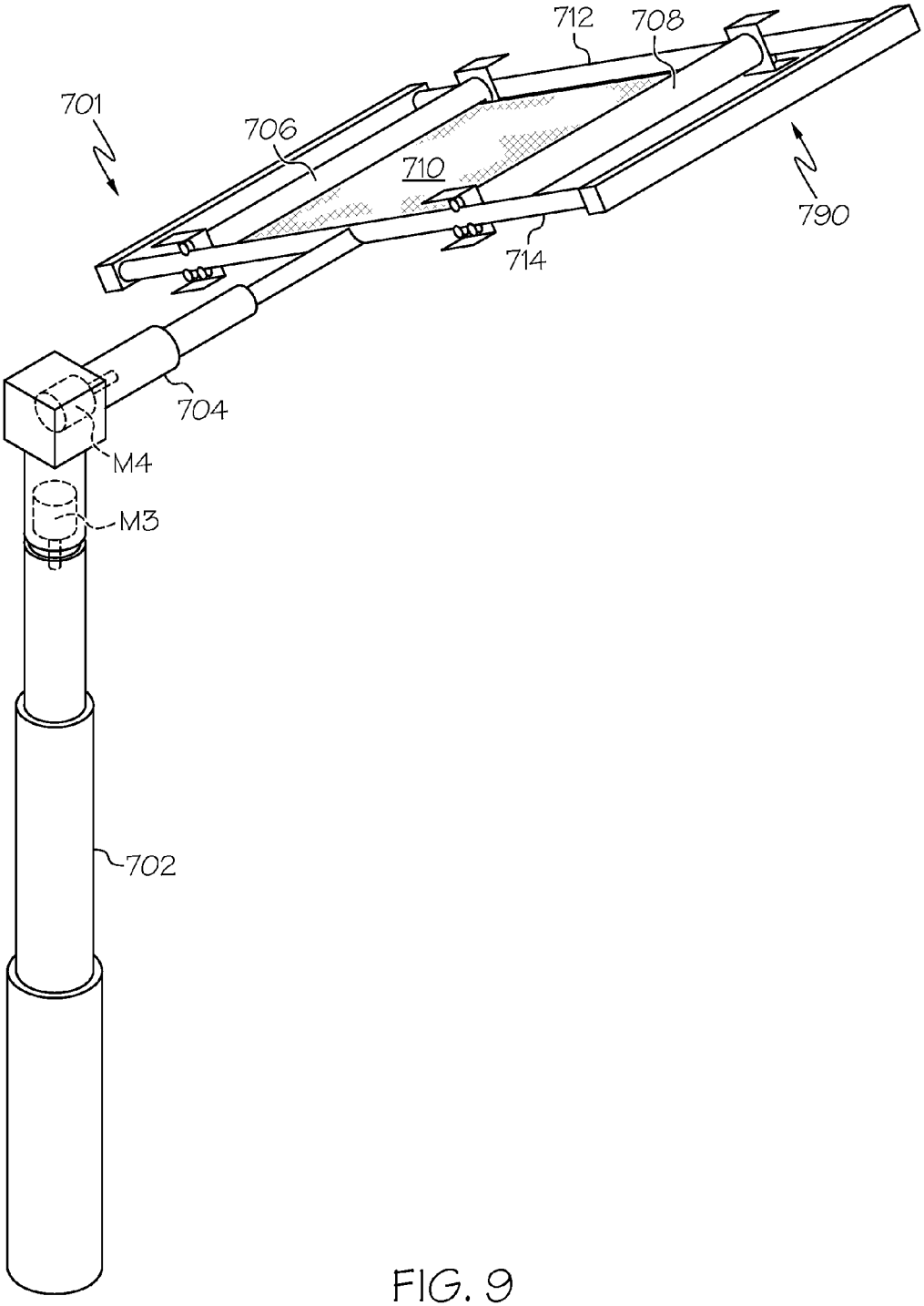
FIG. 9 further illustrates one of the pole-mounted shade devices of FIG. 7 in additional detail deployed in a second position in accordance with another embodiment of the present disclosure.
Figure 10:
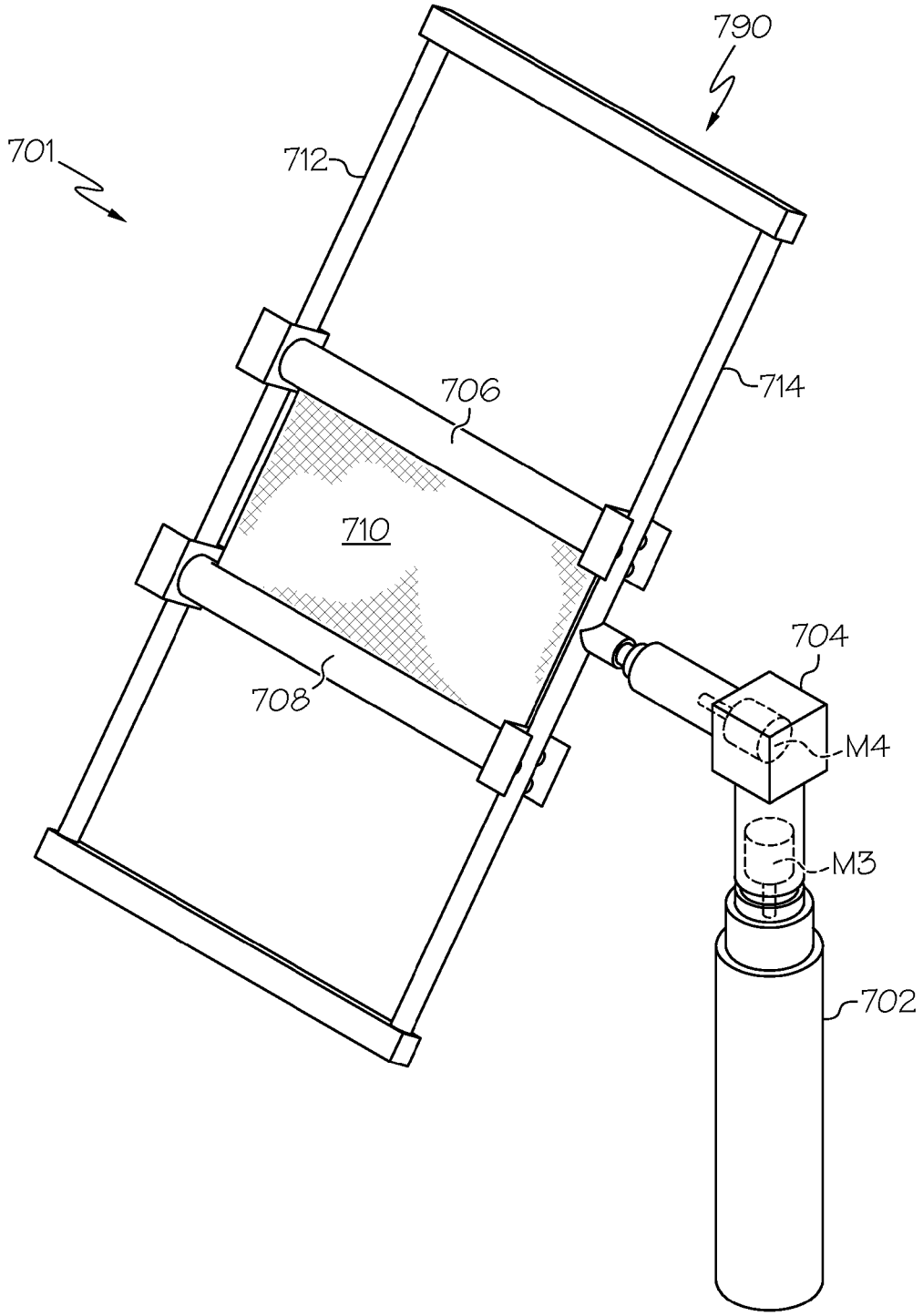
FIG. 10 further illustrates one of the pole-mounted shade devices of FIG. 7 in additional detail deployed in a third position in accordance with yet another embodiment of the present disclosure.

With reference to FIG. 8, an adjustable shade 701 of shade device 700 of FIG. 7 is illustrated in additional detail deployed in a first position in accordance with one embodiment of the present disclosure. With reference to FIG. 9, an adjustable shade 701 of shade device 700 of FIG. 7 is illustrated in additional detail deployed in a second position in accordance with another embodiment of the present disclosure. With reference to FIG. 10, an adjustable shade 701 of shade device 700 of FIG. 7 is illustrated in additional detail deployed in a third position in accordance with yet another embodiment of the present disclosure. As indicated, control unit 792 preferably adjusts adjustable shade 701 between these and other positions and configurations in order to shade a selected movable object on or adjacent sport court 750, such as a sport participant.

Figure 10A:
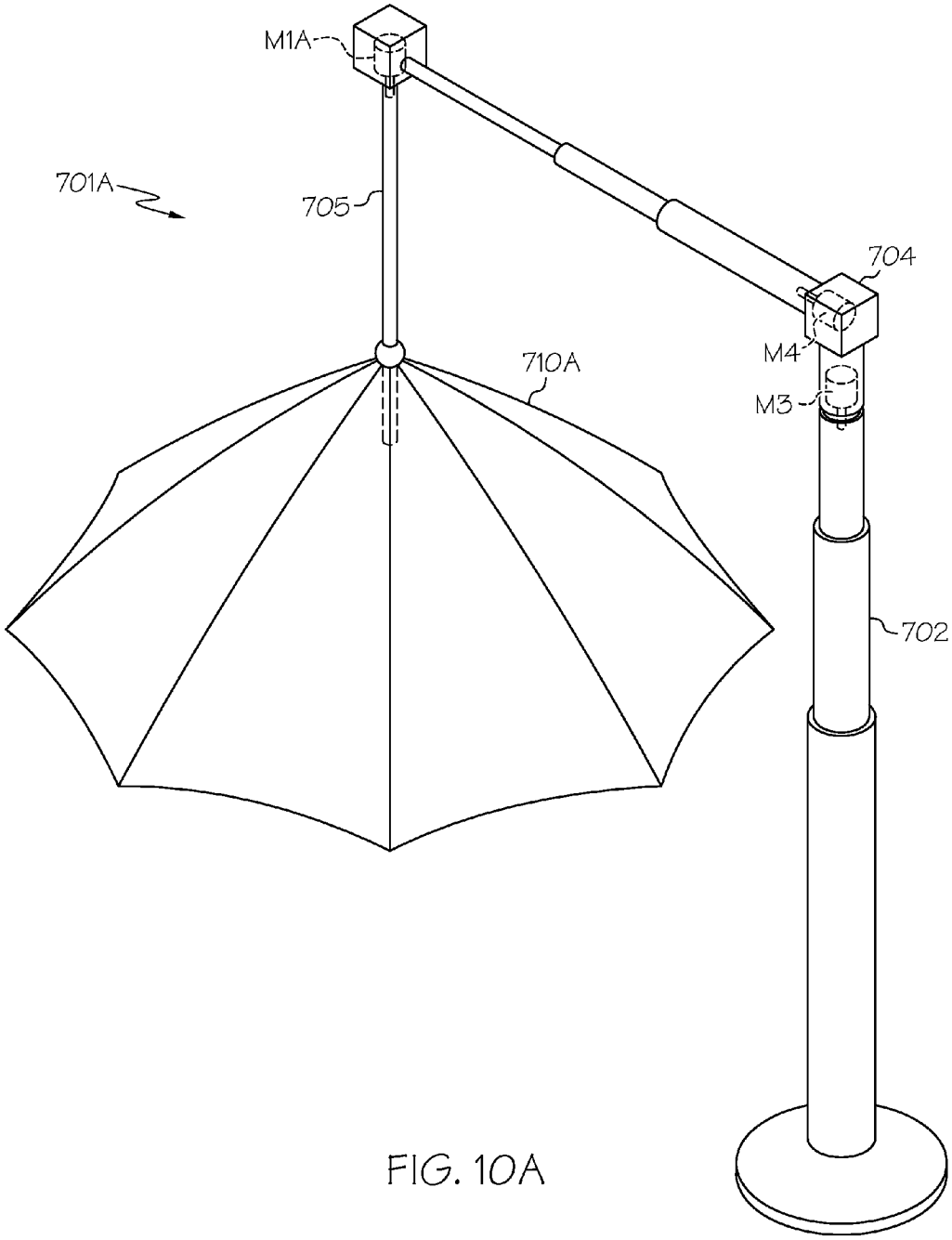
FIG. 10A is a perspective view of pole-mounted umbrella (shade device) for a sport court configured in accordance with one embodiment of the present disclosure with the umbrella open.
Figure 10B:
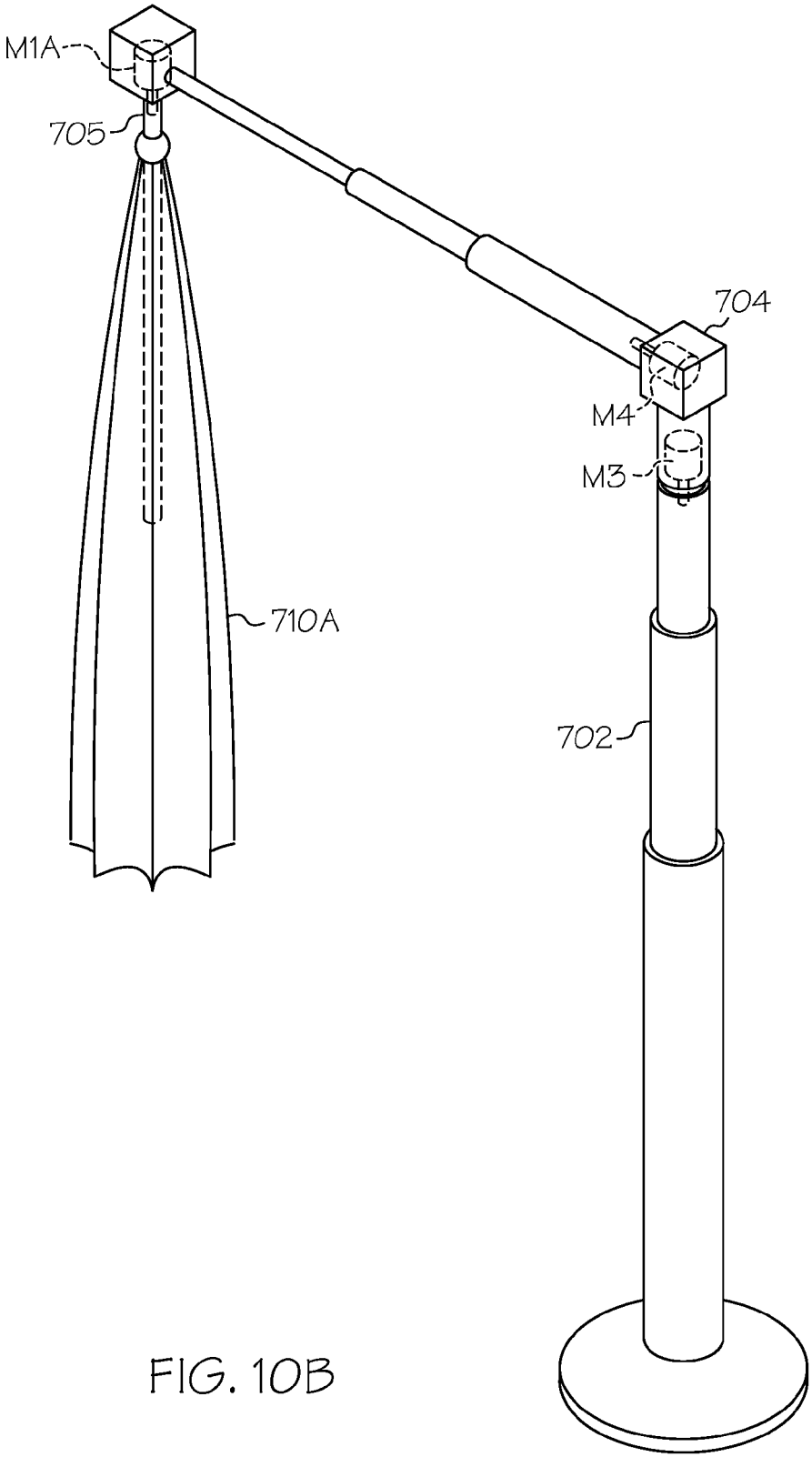
FIG. 10B is a perspective view of the pole-mounted shade device of FIG. 10A with the umbrella closed.
Figure 10C:
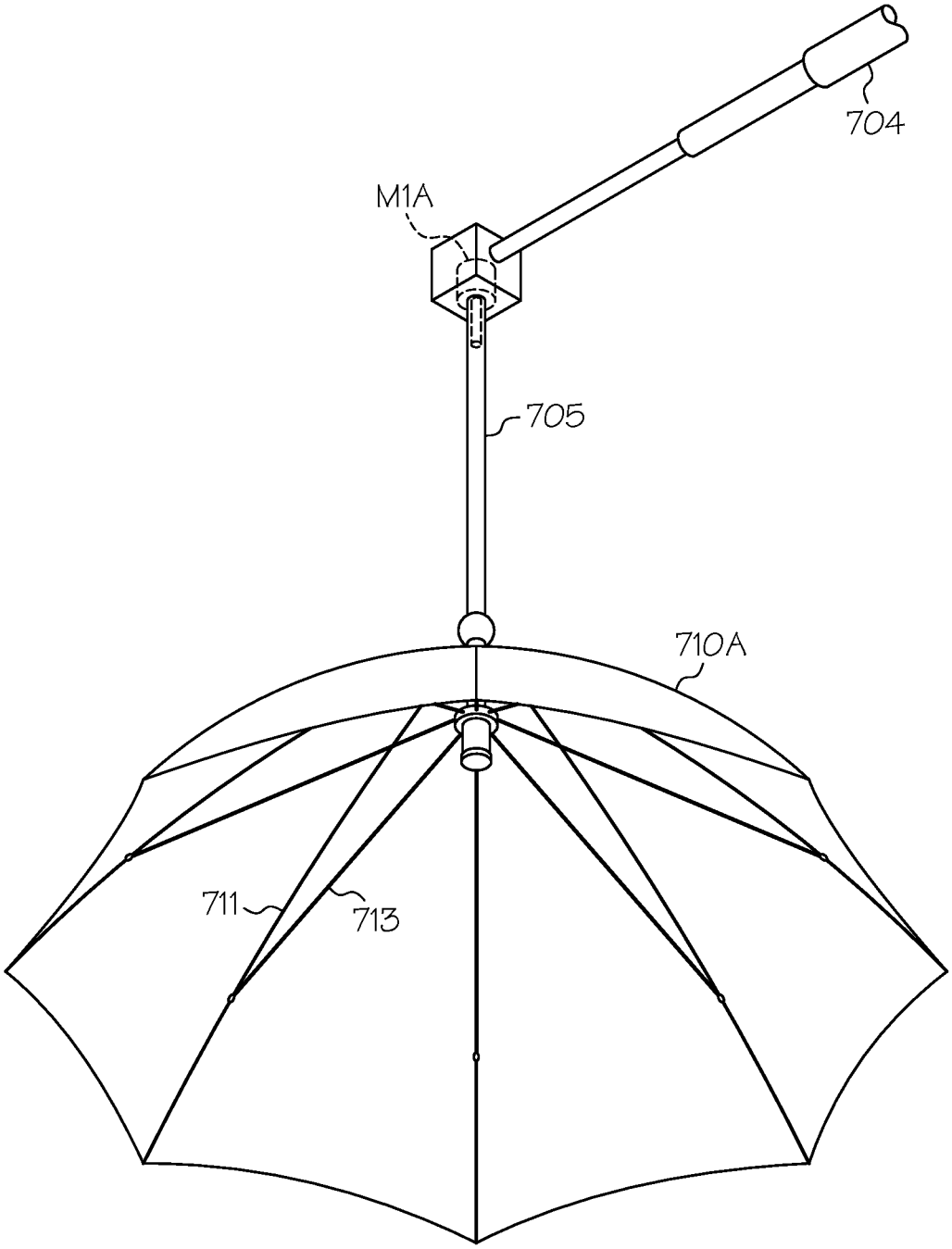
FIG. 10C is another view of a relevant portion of the pole-mounted shade device of FIG. 10A further illustrating the ribs of the umbrella.

With reference to FIGS. 10A-10C, a pole-mounted adjustable umbrella (shade) 701A, in accordance with another embodiment of the present disclosure, is illustrated. It should be appreciated that a pole-mounted shade device configured according to the present disclosure may include one or more adjustable umbrellas 701A that may be configured in a same fashion or a different fashion. Each adjustable umbrella 701A includes a cover (e.g., a fabric cover) 710A with a first opening that receives rod 705, a second member 704 coupled to rod 705 adjacent a first end of second member 704, and a first member 702 coupled to second member 704 adjacent a second end of second member 704. Cover 710A is supported by ribs 711 and 713 and is opened and closed by actuating motor unit M1A. That is, actuating motor unit M1A in one direction drives a threaded sleeve of rod 705 to open cover 710A and actuating motor unit M1A drives the threaded sleeve of rod 705 in an opposite direction to close cover 710A. Although cover fabric 710A, when deployed, defines a generally circular shape, it should be understood that cover fabric 710A may have a different overall form, such as an oval form.

In various embodiments, shade device 701A also includes a control unit 792 (not shown in FIGS. 10A-10C, see FIG. 12) electrically coupled to motor units M1A, M3 and M4. Control unit 792 is configured to control motor units M1A, M3, and M4 to provide shade for a moveable object (i.e., a sport participant) adjacent an area of a sport court based on a light level at the moveable object. In one or more embodiments, shade device 701A also includes a camera 794 coupled to control unit 792. In this embodiment, control unit 792 is configured to control a size and location of cover 710A based on output from camera 794 to provide shade for the object. Control unit 792 may also be configured to increase and/or maximize shading of the object while reducing and/or minimizing shading of areas on or adjacent a sport court that are not occupied by the object. In another embodiment, shade device 701A also includes a receiver 796 coupled to control unit 792, a light detector 791 associated with the object and configured to provide an indication of the light level at the object, and a transmitter 793 coupled to light detector 791. In this embodiment, transmitter 793 is configured to transmit a signal to receiver 796 that provides the indication of the light level at the object as detected by light detector 791.

In at least one embodiment, control unit 792 is configured to control a size of cover 710A, a length of first member 702, and a length of second member 704 based on the transmitted signal received by receiver 796. In another embodiment, shade device 701A further includes camera 794 coupled to control unit 792. In this embodiment, control unit 792 is configured to control the opening and closing of cover 710A (by controlling motor unit M1A), a length of first member 702, and a length of second member 704 based on images captured by camera 794. In one or more embodiments, first member 702 and second member 704 are both configured to telescope and rotate. In at least one embodiment, control unit 792 is configured to control the opening and closing of cover 710A and respective rotational positions and respective lengths of first member 702 and second member 704 to reduce the light level at the object.

As one example, a camera 794 may be deployed to provide an indication of the light level at the sport participant. In this case, control unit 792 may be deployed in a housing that houses camera 794 and images provided by camera 792 may be analyzed by control unit 792 to determine the light level at the sport participant. As another example, receiver 796 may replace camera 794 and in this case, control unit 792 may be housed in a same housing as receiver 796. In this embodiment, a light detector (e.g., a photodetector) 791 and transmitter 793 may be packaged together and deployed on the sport participant (e.g., clipped to a bill of a hat worn by the sport participant) to transmit an indication of the light level at the sport participant to receiver 796.

Figure 11:
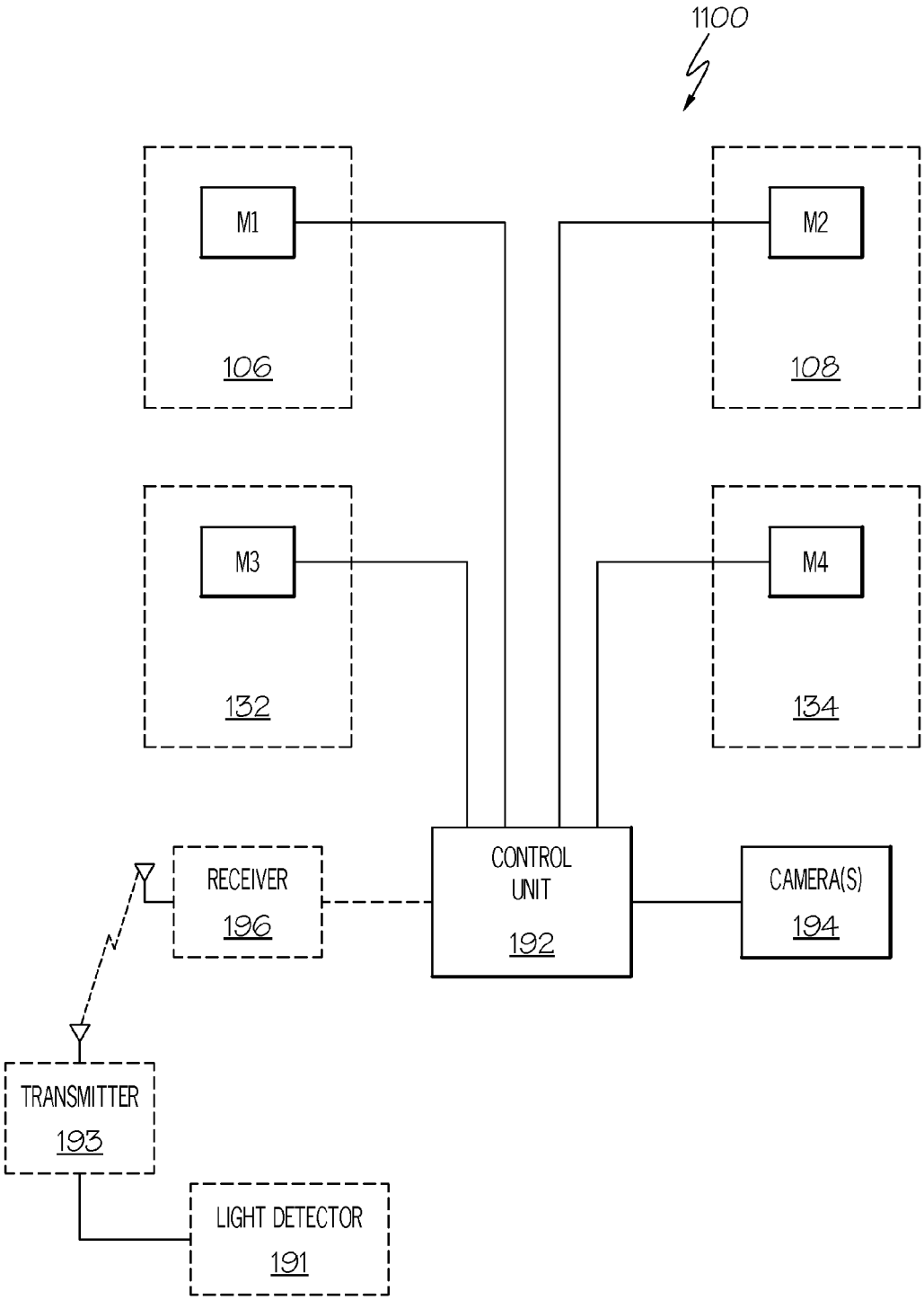
FIG. 11 is an exemplary electrical block diagram of a shade device system that may be implemented in a shade device configured in accordance with FIGS. 1-6.

FIG. 11 is an exemplary electrical block diagram of a system 1100 that may be implemented for a shade device configured in accordance with FIGS. 1-6. As is illustrated, control unit 192 is electrically and/or communicatively coupled to a motor unit M1 (located in first motorized support 106), a motor unit M2 (located in second motorized support 108), a motor unit M3 (located in first motorized drive 132), and a motor unit M4 (located in second motorized drive 134). Based on signals received from camera(s) 194 or receiver 196, control unit 192 controls motor units M1 and M2 to increase or decrease a deployed portion of flexible panel 110 and/or a position of the deployed portion of flexible panel 110 with respect to guides 102 and 104 and/or motor units M3 and M4 to change a position of the deployed portion of flexible panel 110 with respect to guides 112 and 114. In one embodiment, control unit 192 analyzes images received from camera 194 to determine how much of flexible panel 110 to deploy and where to position the deployed portion of flexible panel 110. In another embodiment, control unit 192 process signals received (by receiver 196 from transmitter 193 that correspond to light levels detected by light detector 191) to determine how much of flexible panel 110 to deploy and where to position the deployed portion of flexible panel 110. Motor units M1-M4 may each include one or more motors (e.g., servo motors or stepper motors) and associated gear arrangements.

Figure 12:
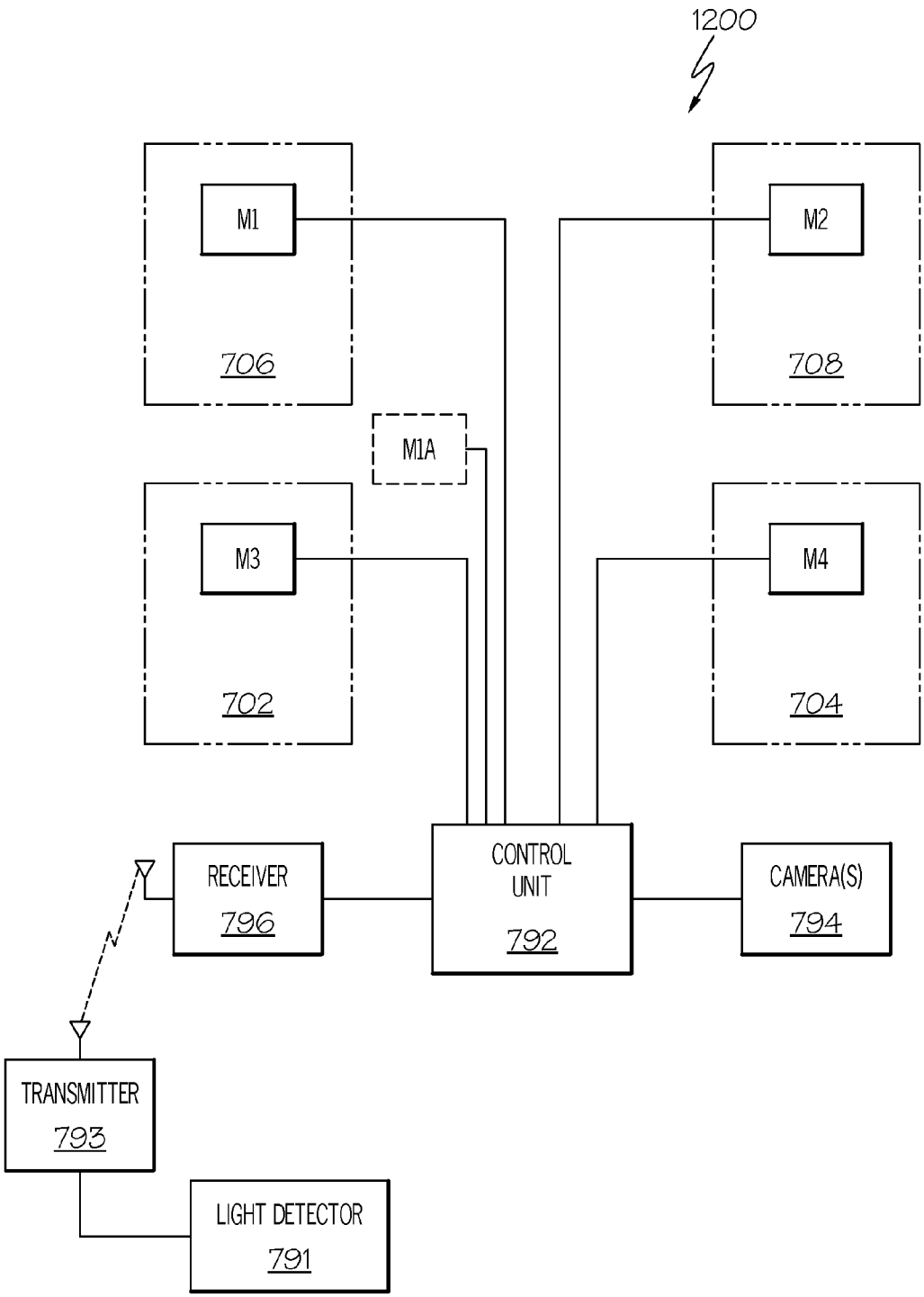
FIG. 12 is an exemplary electrical block diagram of a shade device system that may be implemented in a shade device configured in accordance with FIGS. 7-10C.

FIG. 12 is an exemplary electrical block diagram of a system that may be implemented for a shade device configured in accordance with FIGS. 7-10C. As is illustrated, control unit 792 is electrically and/or communicatively coupled to a motor unit M1 (located in first motorized support 706), a motor unit M2 (located in second motorized support 708), a motor unit M3 (located in first member 702), and a motor unit M4 (located in second member 704). Based on signals received from camera(s) 794 or receiver 796, control unit 792 controls motor units M1 and M2 to increase or decrease a deployed portion of flexible panel 710 and/or motor units M3 and M4 to change a location of the deployed portion of flexible panel 710. In one embodiment, control unit 792 analyzes images received from camera 794 to determine how much of flexible panel 710 to deploy and where to position the deployed portion of flexible panel 710. In another embodiment, control unit 792 process signals received (by receiver 796 from transmitter 793 that correspond to light levels detected by light detector 791) to determine how much of flexible panel 710 to deploy and where to position the deployed portion of flexible panel 710. Motor units M1-M4 may each include one or more motors (e.g., servo motors or stepper motors) and associated gear arrangements.

Control unit 192 or 792 may be configured to select a size of flexible panel 110 or 710 based on one or more parameters, such as, for example, a height of the flexible panel 110 or 710 above the sport court 150 or 750, a detected velocity of the shaded object (e.g., the sport participant), a velocity at which motor units M1-M4 can move flexible panel 110 or 710 to track movements of the shaded object, the relative position (including angle) of the sun, and/or a predetermined maximum, minimum and/or preferred distance between the shaded object and the edge of a shaded region of the sport court. The distance between the shaded object and the edge of the shaded region may be based, for example, on the distance at which a ball (e.g., a tennis ball) will be close enough to a sport participant when entering the shaded region such that the shadow-crossing will not substantially negatively impact the sport participant's ability to visually track the movement of the ball. In the embodiment of FIGS. 10A-10C, motor unit MIA is implemented and motor units M1 and M2 are not present.

While the present invention has been particularly shown as described with reference to one or more preferred embodiments, it will be understood by those skilled in the art that various changes in form and detail may be made therein without departing from the spirit and scope of the invention. For example, although the present invention has been described with reference to various embodiments of a shade device for a sport court, the present invention may be used to provide shade for areas other than a sport court. In addition, in some embodiments, the deployed size and shape of the shade-providing panel may be fixed. Further, in some embodiments in which a shade-providing panel is suspended from cables (e.g., as in the embodiments of FIGS. 1 and 3), the shade-providing panel may be fixed to the cables, and the cables may be spooled and unspooled (e.g., by motors mounted on poles 120-126) in order to move the shade-providing panel. Also, in some embodiments, such as those illustrated in FIGS. 7-10C, hydraulic systems may be alternatively or additionally be utilized to telescope and/or rotate one or more of poles 702, 704.

What is claimed is:

1. A shade device for an outdoor sport court, comprising:

a first guide;

a second guide spaced from the first guide, wherein the first and second guides are substantially parallel;

a first motorized support movably attached adjacent a first end to the first guide and adjacent a second end to the second guide;

a second motorized support movably attached adjacent a first end to the first guide and adjacent a second end to the second guide;

a flexible panel extending between the first motorized support and the second motorized support, wherein at least one of the first and second motorized supports includes a motorized spindle that is configured to roll and unroll the flexible panel to correspondingly decrease and increase a size of the flexible panel available to provide shade, wherein the first and second guides are configured to be installed substantially over one dimension of a sport court;

a third guide;

a fourth guide spaced from the third guide, wherein the third and fourth guides are substantially parallel and the third and fourth guides are configured to be installed substantially perpendicular to the first and second guides over another dimension of the sport court;

a first motorized drive attached to the first and second guides and movably attached to the third guide;

a second motorized drive attached to the first and second guides and movably attached to the fourth guide; and a control unit coupled to the first and second motorized supports and the first and second motorized drives, wherein the control unit is configured to control the first and second motorized supports and the first and second motorized drives to provide shade for a moveable object adjacent an area of the court based on a light level at the moveable object.

2. The shade device of claim 1, wherein the sport court is a tennis court.

3. The shade device of claim 1, further comprising:

a camera coupled to the control unit, wherein the control unit is configured to control a deployed size and location of the flexible panel based on output from the camera.

4. The shade device of claim 3, wherein the control unit is configured to maximize shading of the object while minimizing shading of areas of the court that are not occupied by the object.

5. The shade device of claim 1, wherein the shade device further comprises:

a receiver coupled to the control unit;

a light detector associated with the object and configured to provide an indication of the light level at the object; and a transmitter coupled to the light detector, wherein the transmitter is configured to transmit a signal to the receiver that provides the indication of the light level at the object as detected by the light detector.

6. The shade device of claim 5, wherein the control unit is configured to control the first and second motorized supports and the first and second motorized drives based on the transmitted signal received by the receiver.

7. The shade device of claim 1, further comprising:

a camera coupled to the control unit, wherein the control unit is configured to control the first and second motorized supports and the first and second motorized drives based on images captured by the camera.

8. The shade device of claim 1, wherein the first, second, third, and fourth guides are cables and the flexible panel is a fabric panel.

9. A shade device for an outdoor sport court, comprising:

a first member;

a second member coupled to the first member adjacent a first end of the second member;

a frame coupled to a second end of the second member, wherein the frame includes a first guide and a second guide spaced from the first guide and the first and second guides are substantially parallel;

a first motorized support movably attached adjacent a first end to the first guide and adjacent a second end to the second guide;

a second motorized support movably attached adjacent a first end to the first guide and adjacent a second end to the second guide;

a flexible panel extending between the first motorized support and the second motorized support, wherein at least one of the first and second motorized supports includes a motorized spindle that is configured to roll and unroll the flexible panel to correspondingly decrease and increase a size of the flexible panel available to provide shade; and a control unit coupled to the first and second motorized supports, wherein the control unit is configured to control the first and second motorized supports to provide shade for a moveable object adjacent an area of the court based on a light level at the moveable object.

10. The shade device of claim 9, wherein the sport court is a tennis court.

11. The shade device of claim 9, further comprising:

a camera coupled to the control unit, wherein the control unit is configured to control a size and location of the flexible panel based on output from the camera to provide shade for the object.

12. The shade device of claim 11, wherein the control unit is configured to maximize shading of the object while minimizing shading of areas on or adjacent the court that are not occupied by the object.

13. The shade device of claim 9, further comprising:

a receiver coupled to the control unit;

a light detector associated with the object and configured to provide an indication of the light level at the object; and a transmitter coupled to the light detector, wherein the transmitter is configured to transmit a signal to the receiver that provides the indication of the light level at the object as detected by the light detector.

14. The shade device of claim 13, wherein the control unit is configured to control the first and second motorized supports, a length of the first member, and a length of the second member based on the transmitted signal received by the receiver.

15. The shade device of claim 9, further comprising:

a camera coupled to the control unit, wherein the control unit is configured to control the first and second motorized supports, a length of the first member, and a length of the second member based on images captured by the camera.

16. The shade device of claim 9, wherein the first and second members are both configured to telescope and rotate.

17. The shade device of claim 16, wherein the control unit is configured to control the first and second motorized supports and respective rotational positions and respective lengths of the first and second members to reduce the light level at the object.

18. A shade device for an outdoor sport court, comprising:

a first guide;

a second guide spaced from the first guide, wherein the first and second guides are substantially parallel;

a first motorized support movably attached adjacent a first end to the first guide and adjacent a second end to the second guide;

a second motorized support movably attached adjacent a first end to the first guide and adjacent a second end to the second guide;

a fabric panel extending between the first motorized support and the second motorized support, wherein at least one of the first and second motorized supports includes a motorized spindle that is configured to roll and unroll the fabric panel to correspondingly decrease and increase a size of the fabric panel available to provide shade, wherein the first and second guides are configured to be installed substantially over one dimension of a sport court;

a third guide;

a fourth guide spaced from the third guide, wherein the third and fourth guides are substantially parallel and the third and fourth guides are configured to be installed substantially perpendicular to the first and second guides over another dimension of the sport court;

a first motorized drive attached to the first and second guides and movably attached to the third guide;

a second motorized drive attached to the first and second guides and movably attached to the fourth guide;

a camera positioned to receive an indication of a light level at a moveable object adjacent an area of the court; and a control unit in communication with the camera and coupled to the first and second motorized supports and the first and second motorized drives, wherein the control unit is configured to control the first and second motorized supports and the first and second motorized drives to provide shade for the moveable object based on the light level at the object.

19. The shade device of claim 18, wherein the control unit is configured to control a size and location of the flexible panel based on analysis of images provided by the camera.

20. The shade device of claim 19, wherein the control unit is configured to maximize shading of the object while minimizing shading of areas of the court that are not occupied by the object.

* * * * *